US005199451A

United States Patent [19]

Montoli

[11] Patent Number: 5,199,451

[45] Date of Patent: Apr. 6, 1993

[54] COMPACT WITH POP-UP TRAY OPERATED BY HINGED COVER

[75] Inventor: Antonio Montoli, Vedano Olona, Italy

[73] Assignee: Risdon Corporation, Naugatuck, Conn.

[21] Appl. No.: 895,012

[22] Filed: Jun. 8, 1992

[51] Int. Cl.[5] ..... A45D 27/22

[52] U.S. Cl. ..... 132/315; 132/294; 132/301; 132/314; 206/581; 206/823

[58] Field of Search ..... 132/294, 295, 296, 298, 132/299, 301, 303, 304, 305, 314, 315; 206/581, 804, 823

[56] References Cited

U.S. PATENT DOCUMENTS

| | | | |
|---|---|---|---|
| 1,597,378 | 8/1926 | Kendall | 132/303 |
| 1,688,042 | 10/1928 | Gaess | 132/295 |
| 2,526,596 | 10/1950 | Williamson | 206/823 |
| 2,642,202 | 6/1953 | Cowan | 132/301 |
| 2,712,318 | 7/1955 | Root | 132/301 |
| 2,737,189 | 3/1956 | Morningstar et al. | 132/305 |
| 4,474,196 | 10/1984 | Yuhara | 132/301 |
| 4,684,017 | 8/1987 | Watanabe et al. | 206/581 |
| 4,805,770 | 2/1989 | Grobecker et al. | 206/804 |
| 4,917,131 | 4/1990 | Contreras, Sr. | 132/301 |
| 5,092,354 | 3/1992 | Pacelli, Jr. | 132/315 |

FOREIGN PATENT DOCUMENTS

| | | | |
|---|---|---|---|
| 3626743 | 2/1987 | Fed. Rep. of Germany | 132/303 |
| 2199807 | 7/1988 | United Kingdom | 206/823 |

*Primary Examiner*—Gene Mancene
*Assistant Examiner*—Frank A. LaViola
*Attorney, Agent, or Firm*—Dallett Hoopes

[57] ABSTRACT

A makeup compact base has a frame or insert secured thereto. The frame features flexible downward wings having retaining ribs across the lower ends thereof. A cosmetic tray may have a top flange adapted to sit in the frame, and complimenting grooves on the outside of the tray snappingly receive the ribs so that normally the tray is held snugly down inside the frame. The compact cover is hinged and is shaped in a portion adjacent the hinge so that when the compact is forced open beyond its normal open position said portion forces the tray up out of its frame to make it available for replacement.

8 Claims, 2 Drawing Sheets

COMPACT WITH POP-UP TRAY OPERATED BY HINGED COVER

BACKGROUND OF THE INVENTION

1. Field of the Invention

This invention relates to a makeup compact having a cosmetic tray which may be popped out of the compact by using the hinged cover as a force-applying lever.

2. Description of Related Art including Information Disclosed under §§1.97 to 1.99

The prior art includes a number of patents and printed publications dealing with compacts by which the tray may be popped out of the compact for replacement. In the German published application 3,626,743 published Feb. 12, 1987, for instance, there is a tray which may be popped out of its compact by a special Z-shaped lever including a foot which underlies the tray and an operating tab which, when pressed, pivots the foot upward to displace the tray from the container base.

The old U.S. Kendall Pat. No. 1,597,378 discloses a compact in which the cover latch is operated by a button and by pressing the button further a wedge attached to the button may be driven under the tray to pop the tray out of the compact base.

SUMMARY OF THE INVENTION

The prior arrangements for popping the powder tray out of a compact all involve the manual pressing of a button or the like to eject the tray. Often this requires considerable force on the button and is not easy for an aged or weak person to do.

The present invention is a compact which uses the leverage of a rather sizeable cover to drive the cosmetic tray out of its position in the compact. The compact comprises a base, a hinged cover and a frame or insert secured to the base and featuring flexible downward wings having retaining means on the lower ends thereof. A cosmetic tray has a top outward flange and sits in the frame and has complimentary retaining means about its sides to engage the retaining means on the outside of the tray so that normally the tray is held snugly down inside the frame.

One of the wings is provided on its lower end with an outward and upwardly formed wedge, and the opposite sides of that wing is formed with a button which extends through an opening in the compact base adjacent the cover hinge. In operation, the cover may be forced open beyond the limit of its normal travel so that a specially shaped part of the cover adjacent the hinge engages the button to depress the button, moving the wedge to drive up the tray, popping it out of its frame.

In a simpler modification in a specially shaped part of the cover adjacent the hinge directly engages the flange of the tray from below and forcing the cover past the normal open position thereby levers the tray up away from the engagement of the retaining means.

BRIEF DESCRIPTION OF THE DRAWINGS

Further objects and features of the invention will be apparent from the following specification and the drawings, all of which disclose a non-limiting embodiment of the invention. In the drawings.

DESCRIPTION OF THE PREFERRED EMBODIMENT

Figure 1:
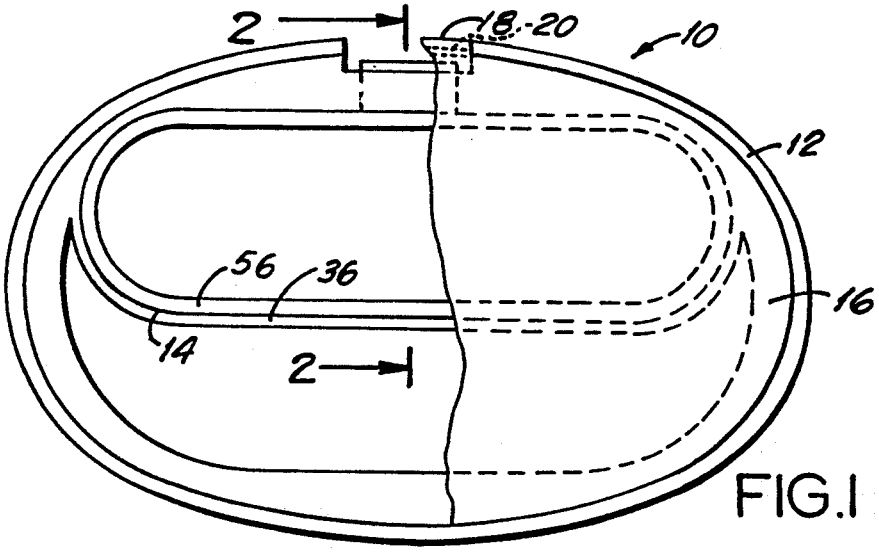
FIG. 1 is a top view of a compact embodying the invention with the cover partly broken and the base shown partly in broken lines.

A compact embodying the invention is generally designated 10 in FIG. 1. It comprises a base 12 of any particular shape (oval being shown for illustration) having a recess 14 therein.

Figure 2:
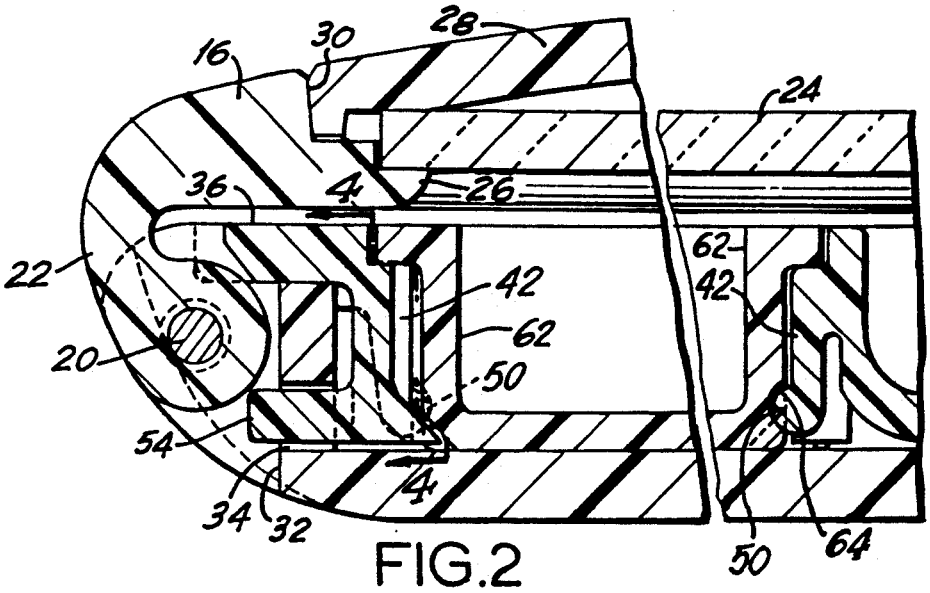
FIG. 2 is an enlarged broken fragmentary sectional view taken on the line 2—2 of FIG. 1.

A cover 16 includes a hinge 18 which is pivoted to the base 12 by means of a pin 20. When the compact is not in use the cover 16 is held in the closed position by latch means (not shown) opposite the hinge. As shown in FIG. 2, the cover adjacent the hinge is formed with a knee or cam means 22 for reasons which will appear. A mirror 24 may be inserted in the cover against a shoulder 26 and held down by a separate cover insert 28 which may be welded into the cover as at 30.

The base adjacent the hinge 20 is formed with a vertical wall 32 and an opening 34 for reasons which will appear.

Figure 4:
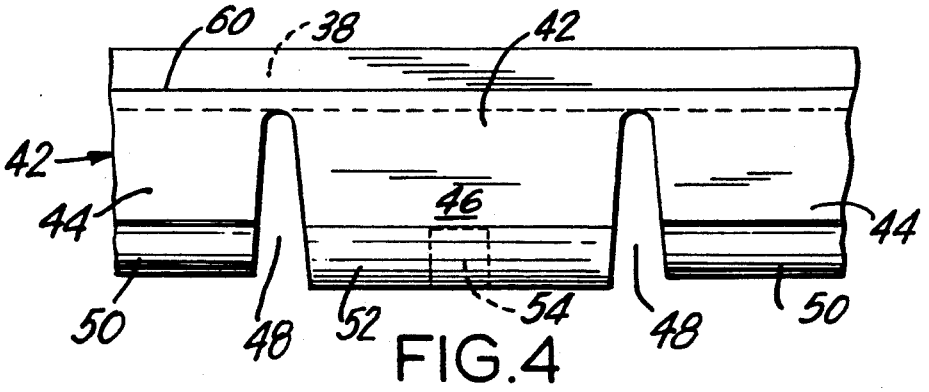
FIG. 4 is a sectional view taken on the line 4—4 of FIG. 2.

A frame or insert 36 is formed with the same general shape as the recess 14. It includes a flange 38 which is welded to the top of the base, and a downward peripheral wall 42 which may be sectioned into separate wings 44 and 46 (FIG. 4) divided by notches 48. The wings 44, except wing 46, are provided with inward ribs 50 for reasons which will appear, and the central wing 46 is provided with an inward wedge 52 which extends inward in the recess as shown. The wing 46 is stiffly flexible. The wing 46 is provided opposite the wedge 52 with rearward button 54 (FIG. 2).

A molded cosmetic powder tray 56 is provided and includes a cup-like element having an outward flange 58 around the upper end thereof. The frame 36 is notched out about the upper end thereof to provide a ledge as at 60 on which the flange 58 sits. The lower portions of the side walls 62 of the tray 56 are formed with inward grooves 64 adapted to receive the ribs 50 as shown releasably to hold down the tray in the frame. Both edges at the lower end of the tray may be beveled off as shown at 66 to complement the shape of the wedge 52 (FIG. 2). This makes it possible to reverse the tray.

Figure 3:
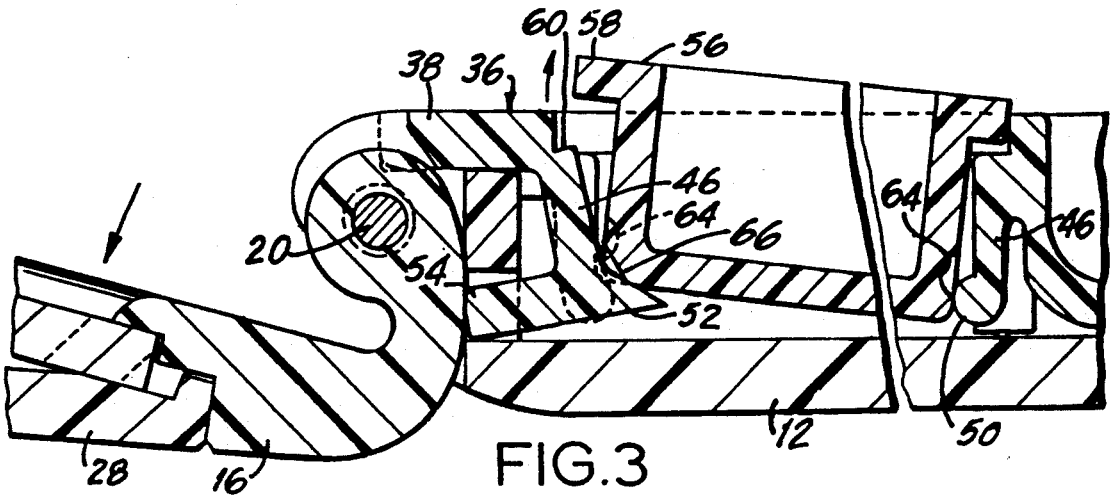
FIG. 3 is a sectional view comparable to FIG. 2 but showing the cover adjacent the hinge being used to drive the wedge inward, popping the tray out of its frame.

The operation of the compact shown involves the opening of the cover 16 beyond its normal open position limit. In FIG. 3, it is shown that when the cover is forceably opened past its normal open limit, the knee 22 on the cover adjacent the hinge 20, engages the butt end of the button 54 to push in the stiffly flexible wing 46 and drive the wedge 52 inward. The wedge thus impinges against the beveled area 66 and urges the tray upward. This causes the resilient wings 44 to flex outward as bottoms of the grooves 50 cam ribs 64 outward of the recess. This eventually leads to the release and upward popping of the tray 56. It will, thus, be seen that using the leverage of the cover 16, it is possible for the user easily to drive in the button 54 using a very nominal force on the cover.

When subsequently it is desired to install a new tray 56 into the frame 36, it is merely necessary to release the cover from the forceable position shown in FIG. 3 to permit the wings 44, 46 to return to their normal vertical position. At this point the new tray 56 may be pressed into the recess. The ribbed ends of the wings 44 will snap into the grooves 50.

MODIFIED FORM OF THE INVENTION

Figure 5:
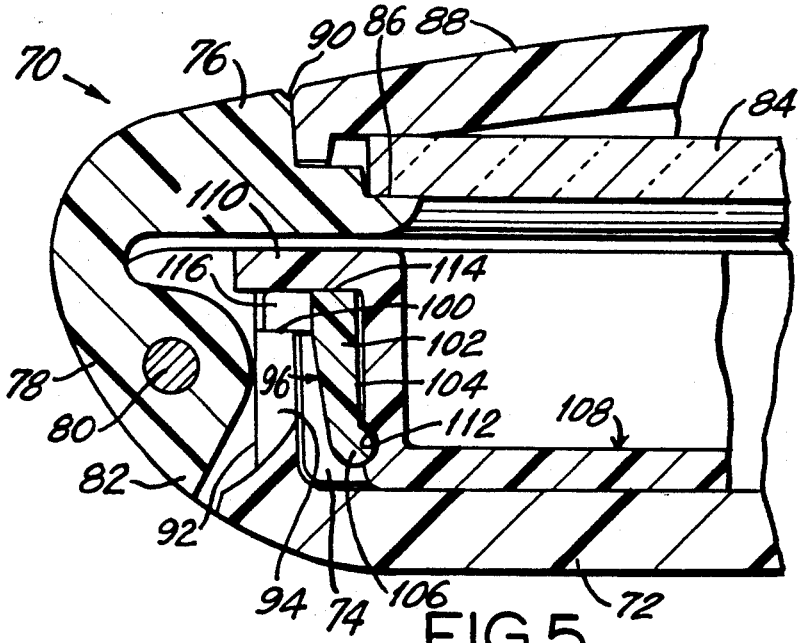
FIG. 5 is a view similar to FIG. 2 but showing a modified form of the invention.
Figure 6:
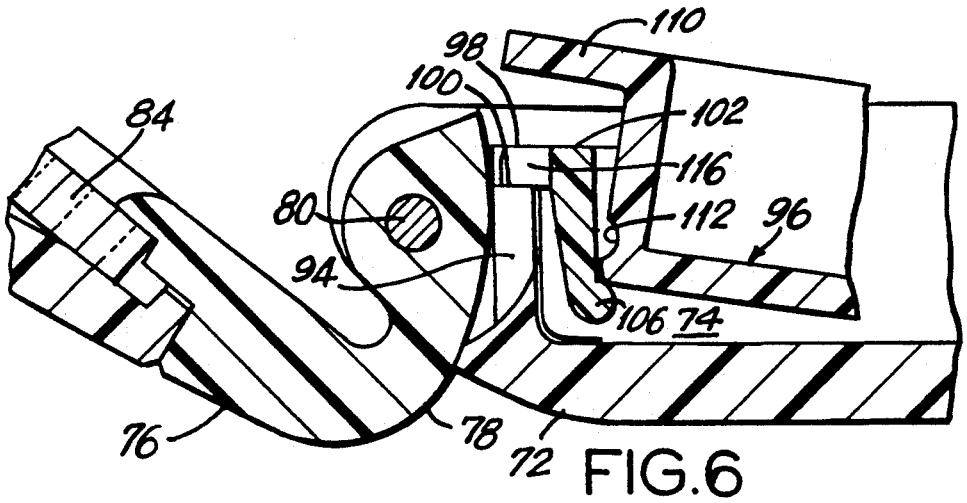
FIG. 6 is a view similar to FIG. 3 but showing the same modification.

A modified form of the invention is shown in FIGS. 5 and 6 and generally designated 70. In outward appearance it is comparable to the compact of FIG. 1. It comprises the base 72 of any convenient shape, oval being shown. The base has the recess 74.

A cover 76 includes a hinge 78 which is pivoted to the base 72 by means of pin 80. When the compact is not in use, the cover 76 is held in the closed position by latch means, not shown, opposite the hinge. As shown in FIG. 5, the cover adjacent the hinge is formed with knee or cam means 82. A mirror 84 may be held in the cover against a shoulder 86 and clamped down by a separate cover insert 88 which may be welded to the cover at 90. The base adjacent the hinge is formed with a vertical wall 92 and a window 94 for reasons which will appear.

A frame or insert 96 fits against the top of the base in the recess 74. It includes a flange 98 which is welded to the top of the base as at 100 and a downward peripheral wall 102 which may be segmented as in the earlier embodiment to define flexible wings 104 provided with inward ribs 106.

As in the earlier embodiment, a cosmetic powder tray 108 is provided and includes a cup-like element having an outward flange 110 around the upper end thereof. The flange is of greater width than the flange 38 of the earlier embodiment. The flange 110 sits on the top of frame 96. The lower portion of the side walls of the tray are formed with inward grooves 112 adapted to receive the ribs 106, as shown, releasably to hold down the tray in the frame.

As shown in FIG. 5, the frame 96 is notched out at 116 above the window 94 in the base.

Referring now to FIG. 6, the window 94 and the notch 116 are designed to pass the knee 82 as the cover pivots about pin 80. Normally the knee 82 will come to rest on the underside of the flange 110 as the flange sits solidly in place as shown in FIG. 5. When, however, the cover is forcibly opened further than the above-described position, the flange 110 will be urged upward by the knee 82 and the tray 96 will be uprooted out of the frame 102, the surface of the groove 112 camming the rib 106 inward to release the tray from its held-down position. The tray is thus available for replacement.

To assure that the tray is not accidentally popped up as the knee contacts the flange 110, circular nibs (shown but not numbered) may be provided and extend inward from the top of the window 94. The knee can rest on these nibs and will pass them only after the cover is forced beyond them.

In inserting a new tray into the compact of FIG. 5 and 6, it is merely necessary to press the new tray 96 downward in the frame 102 until it snaps into place as the ribs 106 engage in grooves 112. At this point the flange 110 will est on the top of the frame at 114.

Thus, in the FIG. 5, 6 embodiment the direct engagement of the knee 82 with the tray 96 effects the popping up of the tray. While the earlier described version is preferred, the FIG. 5, 6 embodiment is somewhat less elaborate and may be preferred by some.

Thus, the invention is not limited to the embodiments shown but the invention is instead defined by the scope of the following claim language, expanded by an extension of the right to exclude as is appropriate under the doctrine of equivalents.

What is claimed is:

1. A compact comprising:

a) an open-box shaped base having a recess therein, b) a frame secured to the base about the recess and having downward panels extending into the recess along the front and back respectively, the panels being formed with spaced vertical slots to define a plurality of downward stubby flexible wings, at least one of the wings being formed with inward retaining ribs, at least one of the wings being formed adjacent its lower end with an inwardly directly wedge having an upwardly and rearwardly sloping upper surface spaced down from the top of the frame, said wing being also formed with a rearward button on the back of the wing, the rear of the base being apertured to pass the button to the outside of the base, c) a shallow tray fitting into the recess, the tray having grooves along the inward surfaces of its front and back sides resiliently and releaseably receiving the retaining ribs to hold the tray in position in the frame, the tray superposing the wedge, d) a cover hinged to the base by hinge means and the common axis of the hinge means being above the button whereby if the cover is opened beyond a normal open position it engages the button to push the wedge under the tray to urge the tray up out of the frame and free of the retaining ribs.

2. A compact as claimed in claim 1 wherein an outward flange is disposed about the top of the tray and the flange butts against the top of the frame.

3. A compact comprising a base having an upwardly facing recess, a powder tray releaseably retained in the recess, a cover having a cam means and hinged to the rear of the base and means associated with the tray to assist in its removal whereby when the cover is opened beyond a usual limit of travel the cam means engages the means associated with the tray to drive the tray up out of the base.

4. A compact as claimed in claim 3 wherein a frame comprising said means associated with the tray is secured to the base and the frame has a downward resilient wall comprising portions having inward retaining means at the lower ends thereof and a wedge underlying the tray and a button on the wall outward of the wedge and the cam means engages the button to drive the wedge inward to pop up the tray.

5. A compact as claimed in claim 4 wherein the downward resilient wall is regmented and the wedge and button are on opposite sides of the same segment and the inward retaining means are on the segments different from said same segment.

6. A compact as claimed in claim 4 wherein the base is apertured adjacent the hinge to pass the button.

7. A compact as claimed in claim 4 wherein the tray is formed with a flange about its upper end and the flange sits on the top of the frame.

8. A compact as claimed in claim 3 wherein the tray has a flange about at least part of its upper end comprising means associated with the tray and the cover may be forced open beyond said usual limit of travel so that the cam means engages the flange and forces the tray up out of the recess.

* * * * *